US010984768B2

(12) United States Patent
Carnevale et al.

(10) Patent No.: US 10,984,768 B2
(45) Date of Patent: Apr. 20, 2021

(54) DETECTING VIBRATO BAR TECHNIQUE FOR STRING INSTRUMENTS

(71) Applicant: International Business Machines Corporation, Armonk, NY (US)

(72) Inventors: Giulia Carnevale, Rome (IT); Marco Gianfico, Sant'Antimo (IT); Ciro Ragusa, Rome (IT); Roberto Ragusa, Rome (IT)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 455 days.

(21) Appl. No.: 15/344,145

(22) Filed: Nov. 4, 2016

(65) Prior Publication Data

US 2018/0130451 A1 May 10, 2018

(51) Int. Cl.
*G10G 3/04* (2006.01)
*G10H 1/00* (2006.01)

(52) U.S. Cl.
CPC ..... *G10G 3/04* (2013.01); *G10H 1/00* (2013.01); *G10H 2210/066* (2013.01);
(Continued)

(58) Field of Classification Search
CPC ..... G10G 1/04; G10G 3/04; G10H 2210/066; G10H 2210/221; G10H 1/00;
(Continued)

(56) References Cited

U.S. PATENT DOCUMENTS 5,488,196 A * 1/1996 Zimmerman ..... G10H 1/0033 84/612
7,446,253 B2 * 11/2008 Knapp ..... G09B 5/065 84/645

(Continued)

FOREIGN PATENT DOCUMENTS

WO 2015028793 A1 3/2015
WO WO-2015028793 A1 * 3/2015 ..... G10H 1/34
WO WO 2015028793 A1 * 3/2015 ..... G06F 3/03547

OTHER PUBLICATIONS

Chen, Y.P. et al., Electric Guitar Playing Technique Detection in Real-World Recordings Based on F0 Sequence Pattern Recognition, In Proc. of 16th Int'l. Society of Music Information Retrieval Conf. (ISMIR), pp. 708-714, Oct. 26-30, 2015.

(Continued)

*Primary Examiner* — David S Warren
*Assistant Examiner* — Christina M Schreiber
(74) *Attorney, Agent, or Firm* — Cuenot, Forsythe & Kim, LLC

(57) ABSTRACT

Detecting vibrato bar technique for a string instrument can include analyzing, using a processor, a note signal of the string instrument to detect a selected instrumental technique from a plurality of instrumental techniques, analyzing, using the processor, a noise signal of the string instrument to detect a change in frequency of the noise signal, and generating, using the processor, a vibrato bar event responsive to detecting the selected instrumental technique and the change in frequency of the noise signal.

25 Claims, 3 Drawing Sheets

(52) U.S. Cl.
CPC ..... *G10H 2210/086* (2013.01); *G10H 2210/211* (2013.01); *G10H 2210/221* (2013.01); *G10H 2220/015* (2013.01)

(58) Field of Classification Search
CPC ..... G10H 2210/086; G10H 2210/211; G10H 2220/015
USPC ..... 84/609
See application file for complete search history.

(56) References Cited

U.S. PATENT DOCUMENTS 7,884,276 B2 * 2/2011 Taub ..... G10H 1/00 84/612
8,193,436 B2 * 6/2012 Sim ..... G10H 1/00 84/616
8,658,879 B2 * 2/2014 Gillette ..... G10H 3/186 84/723
8,772,621 B2 * 7/2014 Wang ..... G10H 1/0016 84/735
9,117,428 B2 * 8/2015 Ierymenko ..... G10H 3/26
2002/0005108 A1 * 1/2002 Ludwig ..... G06F 3/0488 84/600
2008/0188967 A1 * 8/2008 Taub ..... G10H 1/00 700/94
2009/0241758 A1 * 10/2009 Neubacker ..... G10H 1/0008 84/609
2010/0131086 A1 * 5/2010 Itoyama ..... G10H 3/125 700/94
2012/0294457 A1 * 11/2012 Chapman ..... G10H 3/186 381/98
2013/0000464 A1 * 1/2013 Kirsch ..... H04S 7/305 84/609
2018/0130451 A1 * 5/2018 Carnevale ..... G10G 3/04

OTHER PUBLICATIONS

Reboursiere, L. et al., "Left and Right-hand Guitar Playing Techniques Detection." In Proc. of New Interfaces for Musical Expression (NIME), May 21-23, 2012, 4 pg.

* cited by examiner

DETECTING VIBRATO BAR TECHNIQUE FOR STRING INSTRUMENTS

BACKGROUND

This disclosure relates to detecting instrumental techniques for string instruments. A variety of systems are capable of generating a transcription from audio. In the case of music, for example, these systems are capable of analyzing the audio to detect particular notes being played, note durations, and so forth. The systems typically generate the transcription as output. The transcription is usually some form of musical notation. Examples of different forms of musical notation include, but are not limited to, sheet music, a chord chart, and tablature. Appreciably, the musical notation may be specified or expressed in digital form.

More modern systems attempt to discern not only notes and/or durations, but also particular instrumental techniques used by instrumentalists while playing their instruments to generate sound. For example, several systems are capable of analyzing audio from a string instrument to determine the particular instrumental techniques used by the instrumentalist to achieve the resulting sound. As an illustrative example, a transcription system may recognize particular guitar techniques such as pull-offs, hammer-ons, and so forth from audio of the guitar. The usefulness of the resulting transcription may be increased significantly through accurate detection of instrumental techniques.

Some instrumental techniques, however, are difficult to differentiate from other instrumental techniques. In many cases, the resulting transcription of audio from a string instrument lists inaccurate instrumental techniques due to the inability of conventional systems to differentiate one type of instrumental technique from another.

SUMMARY

One or more embodiments are directed to methods of detecting vibrato bar technique. In one embodiment, a method can include analyzing, using a processor, a note signal of a string instrument to detect a selected instrumental technique from a plurality of instrumental techniques, analyzing, using the processor, a noise signal of the string instrument to detect a change in frequency of the noise signal, and generating, using the processor, a vibrato bar event responsive to detecting the selected instrumental technique and the change in frequency of the noise signal.

For example, the string instrument can include a polyphonic pickup that is configured to generate multiple signals. In general, such a pickup is able to generate one signal corresponding to each string of the string instrument. The pickup, e.g., a polyphonic pickup, can include a series of electromagnetic field generators (field generators) that lie beneath each of the strings of the string instrument. Each field generator is capable of generating an electric current, e.g., a signal, in response to a string vibrating and interfering with the electromagnetic field of the field generator. The processor is capable of differentiating between signals considered to be noise and signals for a sounding string.

In one aspect, the selected instrumental technique involves a change in frequency of the note signal. For example, the selected instrumental technique may be a bend or a release. In other aspects, the selected instrumental technique may be a hammer-on, a pull-off, etc.

In another aspect, the note signal and the noise signal are analyzed for a same time interval.

In another aspect, the method can include determining a direction of movement of a vibrato bar based upon a direction of change in frequency of at least one of the note signal or the noise signal. For example, increasing frequency indicates one particular direction of the vibrato bar causing string tension to increase, while decreasing frequency indicates another particular direction of the vibrato bar causing string tension to decrease.

In another aspect, the method can include storing the noise signal in a memory for analysis. Rather than discarding noise signals, as is the case with various conventional systems, noise signals are persisted at least for a limited time and may be recalled for analysis to obtain additional information when the need arises.

In another aspect, the analyzing of the noise signal can include recalling the noise signal for a same time interval as the note signal and analyzing the noise signal for the change in frequency during the same time interval.

In another aspect, the noise signal can include a plurality of noise signals, wherein each noise signal of the plurality of noise signals is for a different string of the string instrument.

In another aspect, the method can include detecting the note signal and the noise signal from a plurality of received signals.

In another aspect, the note signal is for a first string of the string instrument sounding a note and the noise signal is for a second string of the string instrument not sounding a note.

In accordance with the inventive arrangements described herein, one or more noise signals corresponding to string(s) of the string instrument that are not sounding notes are stored and analyzed with note signals to determine whether a vibrato bar is/has been used. Noise signal(s) provide additional information that can be analyzed in combination with analysis of the note signals to reveal particular instrumental techniques being used. In addition to determining whether a vibrato bar is/has been used, the noise signals may also be used to eliminate false positives or errors in detecting instrumental techniques other than vibrato bar usage. Thus, the accuracy of detecting one or more instrumental techniques, e.g., bends or releases, can be confirmed.

In another embodiment, a method for detecting vibrato bar technique can include detecting, using a processor, a note signal and a noise signal from a plurality of signals from a string instrument, analyzing, using the processor, a time interval of the note signal to detect an instrumental technique involving a change in frequency occurring within the time interval, and, in response to detecting the instrumental technique, analyzing, using the processor, the time interval for the noise signal to detect a change in frequency. The time interval for the note signal and the time interval for the noise signal are the same time interval. The method can also include generating, using the processor, a vibrato bar event in response to detecting the instrumental technique and the change in frequency of the noise signal.

One or more embodiments are directed to systems for detecting vibrato bar technique. In one embodiment, a system includes a processor configured to analyze a note signal of a string instrument to detect a selected instrumental technique from a plurality of instrumental techniques, analyze a noise signal of the string instrument to detect a change in frequency of the noise signal, and generate a vibrato bar event responsive to detecting the selected instrumental technique and the change in frequency of the noise signal.

In one aspect, the selected instrumental technique can involve a change in frequency of the note signal. For example, the selected instrumental technique may be a bend or a release. In other aspects, the selected instrumental technique may be a hammer-on, a pull-off, etc.

In another aspect, the note signal and the noise signal can be analyzed for a same time interval.

In another aspect, the processor can be configured to determine a direction of movement of a vibrato bar based upon a direction of change in frequency of at least one of the note signal or the noise signal. For example, responsive to detecting increasing frequency the processor determines a particular direction of the vibrato bar causing string tension to increase. Responsive to detecting decreasing frequency, the processor determines another particular direction of the vibrato bar causing string tension to decrease.

In another aspect, the processor can be configured to store the noise signal in a memory for analysis. As noted, rather than discarding noise signals, noise signals are persisted at least for a limited time and may be recalled for analysis to obtain additional information when the need arises.

In another aspect, the processor can be configured to recall the noise signal for a same time interval as the note signal and analyze the noise signal for the change in frequency during the same time interval.

In another aspect, the noise signal includes a plurality of noise signals, wherein each noise signal of the plurality of noise signals is for a different string of the string instrument.

In another aspect, the processor is further configured to detect the note signal and the noise signal from a plurality of received signals.

In another aspect, the note signal is for a first string of the string instrument sounding a note and the noise signal is for a second string of the string instrument not sounding a note.

In another aspect, a system for detecting vibrato bar technique includes a processor configured to detect a note signal and a noise signal from a plurality of signals from a string instrument, analyze a time interval of the note signal to detect an instrumental technique involving a change in frequency occurring within the time interval, and in response to detecting the instrumental technique, analyze the time interval for the noise signal to detect a change in frequency. The time interval for the note signal and the time interval for the noise signal are the same time interval. The processor can also be configured to generate a vibrato bar event in response to detecting the instrumental technique and the change in frequency of the noise signal.

One or more embodiments are directed to a computer program product for detecting vibrato bar technique. In one embodiment, the computer program product includes a computer readable storage medium having program code stored thereon. The program code is executable by a processor to cause the processor to perform one or more of the various operations described within this specification.

This Summary section is provided merely to introduce certain concepts and not to identify any key or essential features of the claimed subject matter. Other features of the inventive arrangements will be apparent from the accompanying drawings and from the following detailed description.

BRIEF DESCRIPTION OF THE DRAWINGS

The inventive arrangements are illustrated by way of example in the accompanying drawings. The drawings, however, should not be construed to be limiting of the inventive arrangements to only the particular implementations shown. Various aspects and advantages will become apparent upon review of the following detailed description and upon reference to the drawings.

DETAILED DESCRIPTION

Figure 1:
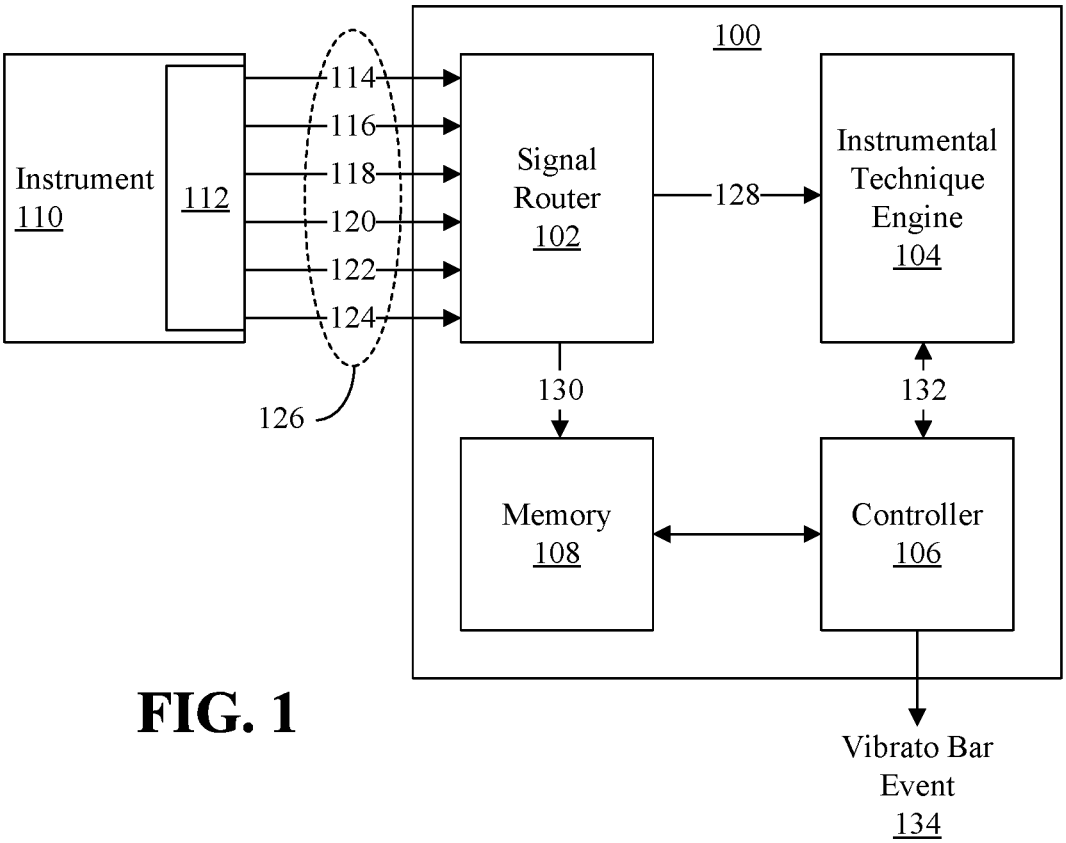
FIG. 1 illustrates an example processor configured for detecting vibrato bar technique.

While the disclosure concludes with claims defining novel features, it is believed that the various features described within this disclosure will be better understood from a consideration of the description in conjunction with the drawings. The process(es), machine(s), manufacture(s) and any variations thereof described herein are provided for purposes of illustration. Specific structural and functional details described within this disclosure are not to be interpreted as limiting, but merely as a basis for the claims and as a representative basis for teaching one skilled in the art to variously employ the features described in virtually any appropriately detailed structure. Further, the terms and phrases used within this disclosure are not intended to be limiting, but rather to provide an understandable description of the features described.

This disclosure relates to detecting instrumental techniques for string instruments. One or more embodiments described within this disclosure are directed to detecting the use or application of a vibrato bar technique for string instruments. Methods, systems, and machine readable storage media are described that facilitate the analysis of audio for a string instrument to determine whether a vibrato bar technique is used on the string instrument in generating the audio.

In one or more embodiments, a system is configured to analyze signals from a string instrument. The signals may be analyzed using any of a variety of audio analysis techniques. For example, the system is capable of analyzing attack, decay, sustain, and release (ADSR) envelopes of the signals. Using audio analysis techniques, the system is capable of determining which signals from the string instrument are note signals and which signals are noise signals. A note signal is a signal of a string of the string instrument that is determined to include or specify a note. The note signals are signals of strings that are being played or are sounding. A noise signal is a signal of a string of the string instrument that is determined not to include or specify a note. The noise signals are, in effect, the signals of strings that are not being played. Throughout this disclosure the term "noise signals" is utilized. It should be appreciated, however, that one or more embodiments are operative on a single noise signal. As such, use of the plural form of the term throughout this disclosure is not intended to be limiting as to the particular number of noise signals used for storage and/or analysis unless the context clearly indicates use of a single noise signal or a plurality of noise signals.

The system is configured to utilize the note signal to determine an instrumental technique used in generating the note signal. In cases where a selected type of instrumental technique is detected, the system is capable of performing further analysis on one or more of the noise signals. By analyzing the noise signal as described herein, the system is capable of discerning whether a vibrato bar is/has been used in generating the note signal. The system is capable of utilizing the noise signals, which are typically regarded as "unwanted" signals induced on other strings of the string instrument, to recognize use of the vibrato bar. Conventional systems, for example, operate on filtered versions of the signals from the string instrument where the noise signals are removed or discarded. As such, within conventional systems, the noise signals discussed above are unavailable for performing any type of analysis.

In accordance with the embodiments described herein, the system is capable of storing the noise signals, at least temporarily. The system is configured to utilize these noise signals under particular circumstances such as in response to detecting one or more selected instrumental techniques. If, for example, the selected instrumental techniques are not detected, the noise signal may be discarded or deleted. If one or more of the selected instrumental techniques are detected, the system is capable of recalling the noise signal, performing analysis on the noise signal, and, responsive to making a determination as to whether the vibrato bar is or has been used, discard the noise signals.

Further details relating to the embodiments described within this disclosure are provided with reference to the figures. For purposes of simplicity and clarity of illustration, elements shown in the figures have not necessarily been drawn to scale. For example, the dimensions of some of the elements may be exaggerated relative to other elements for clarity. Further, where considered appropriate, reference numbers are repeated among the figures to indicate corresponding, analogous, or like features.

FIG. 1 illustrates an example processor 100. Processor 100 is configured to detect the use or application of a vibrato bar type of instrumental technique from audio. In the example of FIG. 1, processor 100 includes a signal router 102, an instrumental technique engine (engine) 104, and a controller 106. Processor 100 may also include a memory 108. In one or more embodiments, memory 108 may be located outside of processor 100.

As shown, processor 100 is coupled to an instrument 110. Instrument 110 is a musical instrument and, more particularly, a string instrument. Instrument 110 includes a pickup 112. Instrument 110 may be implemented as any of a variety of different string instruments that have a vibrato bar (not shown) and a pickup 112. Examples of string instruments include, but are not limited to, an electric guitar, an acoustic guitar, an electric bass guitar, and so forth where each is equipped with a vibrato bar and a pickup 112 as described herein.

In one or more embodiments, pickup 112 is a polyphonic pickup. In one example, pickup 112 is a hexaphonic pickup. As such, pickup 112 is configured to generate one signal corresponding to each string of instrument 110. In the example of FIG. 1, pickup 112 generates 6 signals 114, 116, 118, 120, 122, and 124. For purposes of description, signals 114-124 may be referred to herein from time-to-time as a composite signal 126. As such, instrument 110 has 6 strings. In other examples, instrument 110 may have more than 6 strings or fewer than 6 strings. For example, some guitars have 7 or 8 strings, while bass guitars generally have 4 or 5 strings. Pickup 112 may be adapted to generate a signal for each string of instrument 110.

Pickups generally include a series of electromagnetic field generators (field generators) that lie beneath each of string of the instrument. When a string is plucked or otherwise played, the vibration of the string interferes with the electromagnetic field of the field generators thereby generating an electrical current or signal. Thus, the vibration of the string(s) is translated into electric current. The frequency of the electric current, or signals, represents a musical note or a sounding string. Referring to FIG. 1, each of signals 114-124 is generated by a particular one of the field generators of pickup 112 and corresponds to a particular string of instrument 110.

Though pickup 112 is structured to include one field generator for each string, the proximity of the electromagnetic fields is such that a vibrating string will interfere with the electromagnetic field generated by the field generator directly beneath the string as well as adjacent electromagnetic fields generated by adjacent field generators. For example, presuming string 1 has a field generator 1 located beneath, and a string 2 has a field generator 2 located beneath, etc., vibration of string 1 causes interference in the electromagnetic field generated by field generator 1 as well as that of field generator 2. In some cases, interference of string 1 may cause a waterfall effect that interferes with each of the other electromagnetic fields (e.g., 1-6). Typically, the interference of string 1 in the electromagnetic fields generated by field generators 2-6, for example, is considered noise that can be filtered out and/or reduced with expertise in playing the instrument.

A vibrato bar is a mechanical mechanism that may be added to a string instrument. The vibrato bar is capable of adding a variety of different effects to the sound of the instrument by changing the tension of the string(s). The vibrato bar is usually built into the bridge or tailpiece of the string instrument. Manipulation of the vibrato bar either increases tension on the strings (corresponding to increasing pitch or frequency) or decreases tension on the strings (corresponding to decreasing pitch or frequency). Vibrato bar usage is applied across all strings of the string instrument as opposed to only one or a subset of strings. As such, whether or not an instrumentalist allows more than one string to sound on the string instrument when the vibrato bar is used, the tension of all strings is affected.

For purposes of illustration, a player of a string instrument may operate the vibrato bar to change pitch of the string instrument, at least temporarily. For example, the vibrato bar may be used to add vibrato, portamento, or other pitch bend/change effects to the sound of the string instrument. In general, vibrato bars may be added to string instruments that are plucked or strummed, though this need not be the case.

Alternative names for a vibrato bar include, but are not limited to, a tremolo, a tremolo bar/arm/lever, a vibrato arm/lever, and a whammy bar/arm/lever. The inventive arrangements described within this disclosure may be used with any type of string instrument that has a vibrato bar and that includes a polyphonic pickup. Thus, within this disclosure, the term "string instrument" refers to any string instrument that has a polyphonic pickup and a vibrato bar, which includes acoustic instruments having such added equipment.

Signal router 102 receives composite signal 126. In one or more embodiments, signal router 102 is capable of determining which of signals 114-124 specify a note and which of signals 114-124 do not specify a note. Signal router 102 may distinguish between note and noise signals and route signals accordingly. The particular ones of signals 114-124 that specify a note are referred to herein as "note signals." The particular ones of signals 114-124 that do not specify a note are referred to as "noise signals." Signal router 102 is capable of directing note signals to different locations than noise signals. Signal router 102 can pass note signals to engine 104 via signal 128 and noise signal(s) to memory 108 for storage therein via signal 130. In one example embodiment, signal router 102 includes or implements a filter that is adapted to produces a clean version of the signal(s) by outputting the note signals to one location and outputting the noise signals to another.

In an embodiment, signal router 102 may use threshold analysis to detect which ones of signals 114-124 specify a note and which do not. For example, signal router 102 is capable of determining that any of signals 114-124 having an attack that exceeds a predetermined threshold attack is a note signal. In another example, signal router 102 may determine that any of signals 114-124 having a decay that exceeds a predetermined threshold decay is a note signal. In another example, signal router 102 may utilize a combination of attack and decay analysis to determine which ones of signals 114-124 are note signals and which are noise signals.

In another embodiment, signal router 102 is capable of performing frequency analysis on signals 114-124 to determine which of signals 114-124 are note signals and which are noise signals. As an illustrative example, when a string is played on instrument 110, the signal has a known shape in the frequency domain that can be differentiated from a string that is not played. Signal router 102 is capable of performing frequency analysis on the signal to differentiate note signals from noise signals. Signals for strings that are not playing notes do not have the known shape or envelope and instead include white noise. In another example, signal router 102 is capable of detecting white noise on signals and, in response to detecting the white noise or white noise of at least a minimum threshold on the signals, designating the signals as noise signals.

While different audio analysis techniques are described above, it should be appreciated that any known signal analysis technique for distinguishing between a signal corresponding to a sounding string, e.g., a signal for a string playing a note or notes, and a signal that does not correspond to a sounding string, may be used.

In another embodiment, signal router 102 is configured to implement a filter adapted to recognize a note signal. Signal router 102 is capable of considering any signal not recognized as a note signal as a noise signal. As an illustrative example, consider the case where the second string of instrument 110 is played thereby exciting a field generator of a polyphonic pickup resulting in a note signal for the second string. Other strings such as the first, third, fourth, etc., are not played. In that case, signal router 102 recognizes the signal for the second string as a note signal. Signal router 102 is capable of outputting each received signal except for the note signal (the signal for the second string) as a noise signal. Thus, rather than actively detecting noise in particular ones of the signals, e.g., white noise, signal router 102 may consider any signal not specifying a note to be a noise signal.

In one or more embodiments, signal router 102 is operative to determine whether a string specifies a note despite the particular instrumental technique that is used. For example, signal router 102 is capable of determining which of signals 114-124 specifies a note in the general case without attempting to determine the particular instrumental technique that is in use.

In an embodiment, signal router 102 is operative to detect the condition where one of signals 114-124 is a note signal and each other one of signals 114-124 is a noise signal. In another embodiment, signal router 102 is operative to detect the condition where two or more of signals 114-124 are note signals and each other one of signals 114-124 is a noise signal. In any case, signal router 102 is capable of passing signals 114-124 determined to be note signal(s) as signal 128 to engine 104. The other ones of signals 114-124 determined to be noise signals are passed to memory 108 as signal 130 for temporary storage therein.

In some example implementations, signal router 102 is configured to pass signals 128 and 130 only responsive to detecting particular conditions. In one or more embodiments, signal router 102 is capable of passing signals 128 and 130 as described only in response to determining that at least one of signals 114-124 specifies a note and that the frequency of the note is increasing and/or decreasing in a smooth and continuous manner. For example, ADSR envelopes may be used by signal router 102 for purposes of analysis to determine whether the frequency of a note signal is increasing or decreasing as described. Examples of instrumental techniques that result in a smooth and continuous change in frequency (increase and/or decrease) include a bend and/or a release as described herein in greater detail below.

In one or more embodiments, signal router 102 is capable of passing signals 128 and 130 as described only in response to determining that one or more of signals 114-128 are note signals and the remainder of signals 114-128 are noise signals. In another embodiment, signal router 102 is capable of passing signals 128 and 130 as described only in response to determining that one of signals 114-128 is a note signal and the remainder of signals 114-128 are noise signals.

Engine 104 is capable of processing signal 128. More particularly, technique engine 104 is operative to analyze a received note signal and determine which of a plurality of different instrumental techniques are being used on instrument 110 to create signal 128. Engine 104 is capable of generating output signal 132 to controller 106. Signal 132 indicates the particular instrumental technique(s) detected by engine 104 for signal 128, or for a particular time interval of signal 128 that is analyzed.

In one or more embodiments, the instrumental techniques that are detectable by engine 104 include neck hand techniques in reference to the hand used by the instrumentalist to manipulate strings on a neck/fingerboard/fretboard portion of instrument 110. For example, engine 104 need not be configured to detect plucking vs. picking as would be performed by the strumming hand of an instrumentalist. Example instrumental techniques for the neck hand include, but are not limited to, hammering-on, pulling off, bending, releasing, slide, and so forth. The following provides a general description of known instrumental techniques for a string instrument such as a guitar.

- A "hammer-on" refers to a first note sounding on a selected string and a finger of the instrumentalist's neck hand pressing down on a fingerboard position or fret on the selected string thereby causing a second and different note to sound on the selected string without plucking or strumming the sounding string as the finger of the neck hand presses down. The neck hand finger of the instrumentalist presses down quickly on the selected string while the first note is still sounding. The hammer-on technique is also referred to as "ascending legato" and is characterized by abrupt change in pitch.
- A "pull-off" refers to causing a first note to sound on a selected string and literally pulling off a finger of the neck hand thereby allowing a lower pitched note to sound on the selected string. The pull-off is considered the counterpart to the hammer-on technique and is also called "descending legato." The pull-off technique is characterized by an abrupt decrease in pitch.
- A "bend" refers to stretching a selected string with one or more fingers of the instrumentalist's neck hand as the selected string sounds a note to increase the pitch of the bended note whether gradually or instantly. A bend is often characterized by a slower evolution in pitch as compared to a hammer-on.

A "release" refers to the relaxation of a bend that allows the selected string to return to normal, or non-bended, tension and pitch while sounding. The release is considered a counterpart to the bend technique. A release is often characterized by a slower evolution in pitch compared to a pull-off.

A "slide" refers a finger of the neck hand of the instrumentalist pressing string at a particular position on the fingerboard, e.g., a fret, so that a first note sounds and sliding the finger up or down one or more positions or frets from the position corresponding to the first note causing one or more other notes to be played as the finger slides.

Another instrumental technique is the use of a vibrato bar. In the case of a vibrato bar, a pushing of the vibrato bar into the body of the instrument decreases the tension of the strings thereby causing the pitch (and frequency) of any notes played on the strings of the instrument to go down or decrease. Allowing the vibrato bar to return to a resting position allows the tension of the strings to return (increase) to normal. Normal tension is the tension of the strings of the string instrument at rest without being played. Accordingly, the pitch (and frequency) of the notes being played increases and returns to normal also.

In some cases, a vibrato bar is configured to allow the instrumentalist to pull the vibrato bar away from the body of the instrument. Pulling up or away increases the tension of the strings thereby causing the pitch (and frequency) of any notes playing on the strings of the instrument to go up or increase. Allowing the vibrato bar to return to a resting position allows the tension of the strings to return (decrease) to normal. Accordingly, the pitch (and frequency) of the notes being played decreases and returns to normal also.

Within conventional systems, use of bend and/or release instrumental techniques are often confused with vibrato bar usage. Use of the vibrato bar is often incorrectly identified as a bend, a release, or a combination of one or more bends and releases in a particular sequence. In some cases, hammer-on and pull-off techniques may also be confused with vibrato bar usage. Referring to the prior discussion of interference of strings and pickups, in a well-executed bend or release, the instrumentalist uses the strumming hand to mute unwanted strings to prevent such strings from sounding. When a vibrato arm is used, the strumming hand is moved away from the strings thereby allowing additional noise to be generated from other strings that are not sounding a note. In other words, the strumming hand of the instrumentalist is not able to use the vibrato bar and mute strings at the same time.

In one or more embodiments, responsive to engine 104 detecting that frequency of a note is increasing or decreasing in a smooth way, e.g., continuously, the unfiltered noise signals, represented by signal 130 are analyzed. Examples of smooth changes in frequency include bend and release instrumental techniques.

In one or more embodiments, engine 104 is implemented as the system described by Reboursière et al., "Left and right-hand guitar playing techniques detection," NIME '12, May 21-23, 2012, University of Michigan, Ann Arbor (hereafter "Reboursière et al."). Reboursière et al. disclose various techniques for identifying techniques such as bend, release (opposite of a bend), hammer-ons, pull-offs, and so forth. In this regard, engine 104 is capable of outputting an indication of the particular instrumental technique, or techniques as the case may be, detected from a received signal such as signal 128.

Controller 106 is configured to receive signal 132. Signal 132 specifies the particular instrumental technique identified by engine 104 from signal 128. In one or more embodiments, controller 106 is capable of determining whether engine 104 specifies a selected instrumental technique. For example, controller 106 is capable of determining whether engine 104 indicates a bend or a release instrumental technique via signal 132. In response to determining that signal 128, which is a note signal, exhibits a bend or release instrumental technique, controller 106 recalls the noise signal from memory 108. For example, controller 106 is capable of retrieving, from memory 108, one or more or all of the noise signals for the same time interval for which signal 128 is analyzed by engine 104 for the selected instrumental technique.

In one or more embodiments, controller 106 is capable of providing the retrieved noise signal(s) from memory 108 to engine 104 for analysis. Controller 106 is capable of receiving results from analysis of the noise signal(s) from engine 104. Further, based upon the analysis of signal 128 and the analysis of the noise signal(s), controller 106 is capable of determining whether a vibrato bar technique is or has been used for signal 128.

In an embodiment, engine 104 is capable of determining whether one or more of the noise signals retrieved from memory 108 exhibits a change in frequency. The frequency of one or more or all of the noise signals may increase, decrease, or remain the same. Engine 104 is capable of sending the results of the analysis for the noise signal(s) to controller 106 via signal 132. In that case, in response to detecting the selected instrumental technique on signal 128, e.g., a bend and/or a release, and a change in frequency of the noise signals, controller 106 outputs a vibrato bar event 134.

In an embodiment, engine 104, in addition to determining whether the frequency of the noise signal(s) changes, is capable of determining a direction for a detected change or changes in frequency of the noise signal(s). For example, engine 104 may detect an increase, a decrease, an increase followed by a decrease, a decrease followed by an increase, another longer sequence of changes in frequency, or no change. Engine 104 is capable of sending the results determined from the analysis of the noise signal(s) to controller 106 via signal 132. In that case, in response to detecting the selected instrumental technique on signal 128 and a change in frequency of the noise signals that matches the direction of change in frequency of signal 128, controller 106 outputs a vibrato bar event 134.

In another embodiment, engine 104 is configured to perform a same or similar analysis on the noise signal(s) as is performed on signal 128. For example, engine 104 is capable of analyzing one or more or all of the noise signals retrieved from memory 108 to determine whether an instrumental technique as previously described is detectable for the noise signal(s). Engine 104 is capable of sending results of the analysis, e.g., any instrumental techniques detected for the noise signal(s), to controller 106 via signal 132. In that case, in response to determining that the selected instrumental technique is detected on signal 128 and that the same selected instrumental technique is detected on the noise signal(s), controller 106 outputs the vibrato bar event 134.

In the preceding examples, engine 104 is used to perform analysis on the noise signal(s). In one or more other embodiments, however, controller 106 is capable of performing a frequency analysis on noise signal(s) retrieved from memory 108 in lieu of engine 104. In that case, in response to detecting the selected instrumental technique on signal 128 and a change in frequency of the noise signal(s), controller 106 is capable of outputting vibrato bar event 134. In another example, in response to detecting the selected instrumental technique on signal 128 and a change in frequency of the noise signal(s) that matches changes in frequency of signal 128 in terms of direction when time aligned with the noise signal(s), e.g., for a same time interval, controller 106 is capable of outputting vibrato bar event 134.

In an embodiment, processor 100 is implemented as a single integrated circuit (IC) that includes the various blocks shown as physical circuits. The processor may be implemented as a system-on-chip, a programmable IC such as a field programmable gate array (FPGA), an application specific IC (ASIC), a programmable logic array (PLA), programmable logic circuitry and a controller, and so forth. In another embodiment, processor 100 may be implemented as a plurality of interconnect ICs, where each IC corresponds to a block of processor 100 of FIG. 1 or to a combination of such blocks. In embodiments where processor 100 is an analog IC or ICs, processor 100 may operate on signals 114-124 in analog form. In embodiments where processor 100 is digital, signals 114-124 may be in digital form. For example, signals 114-124 may be digitized by an analog-to-digital converter prior to being provided to processor 100 for analysis.

In another embodiment, processor 100 is implemented as an IC adapted to execute computer readable instructions, e.g., program code. For example, processor 100 may be implemented as a digital signal processor (DSP), a central processing unit (CPU), and so forth. In that case, the various blocks shown represent functional blocks that may be implemented by processor 100 executing program code. Memory 108 may be implemented within, or as part of, processor 100 or separately from processor 100. For example, memory 108, when implanted separately from processor 100, may be accessed through a memory interface and/or memory controller (not shown).

Processor 100 may be implemented in any of a variety of different locations and/or systems. In one embodiment, processor 100 is coupled to, or included within, pickup 112. In another embodiment, processor 100 is part of an assembly that is mounted on instrument 110. In that case, processor 100 may be implemented separately from pickup 112. In another embodiment, processor 100 is included within a standalone processing unit such as a rack mount unit, a console unit, etc. In still another embodiment, processor 100 is included within a data processing system such as a computer.

FIG. 1 illustrates an embodiment that is adapted for real time operation on composite signal 126 as received from a polyphonic pickup. In one or more other embodiments, processor 100 is adapted to operate on recorded audio. For example, composite signal 126 may be recorded and stored in a data storage device, whether analog or digital. Processor 100 may operate on the recorded version of signal 126 as retrieved from the data storage device to generate vibrato bar event(s) 134 indicating usage of a vibrato bar in the recorded audio.

Figure 2:
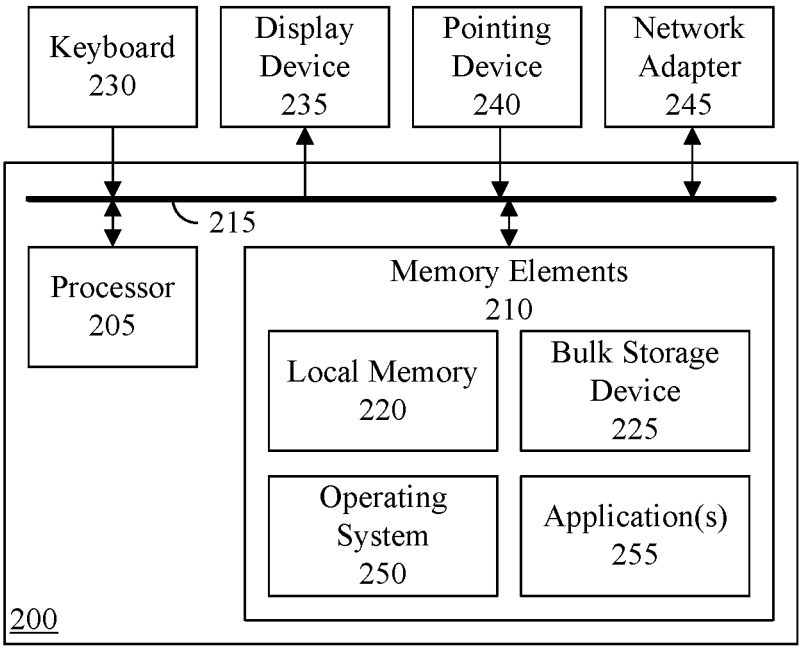
FIG. 2 illustrates an example data processing system configured for detecting vibrato bar technique.

FIG. 2 illustrates an example data processing system (system) 200 configured for detecting vibrato bar technique. System 200 includes at least one processor, e.g., a central processing unit (CPU), 205 coupled to memory elements 210 through interface circuitry. Examples of interface circuitry include an input/output (I/O) subsystem, a bus system, an I/O interface, a memory interface, or other suitable circuitry. System 200 stores program code within memory elements 210. Processor 205 executes the program code accessed from memory elements 210 via interface circuitry 215. In one aspect, system 200 is implemented as a computer or other data processing system that is suitable for storing and/or executing program code. It should be appreciated, however, that system 200 can be implemented in the form of any system including a processor and memory that is capable of performing the functions described within this disclosure.

Memory elements 210 include one or more physical memory devices such as, for example, a local memory 220 and one or more bulk storage devices 225. Local memory 220 refers to random access memory (RAM) or other non-persistent memory device(s) generally used during actual execution of the program code. Bulk storage device 225 may be implemented as a hard disk drive (HDD), solid state drive (SSD), or other persistent data storage device. System 200 may also include one or more cache memories (not shown) that provide temporary storage of at least some program code in order to reduce the number of times program code must be retrieved from bulk storage device 225 during execution.

Input/output (I/O) devices such as a keyboard 230, a display device 235, and a pointing device 240 may optionally be coupled to system 200. The I/O devices may be coupled to system 200 either directly or through intervening I/O controllers. A network adapter 245 may also be coupled to system 200 to enable system 200 to become coupled to other systems, computer systems, remote printers, and/or remote storage devices through intervening private or public networks. Modems, cable modems, Ethernet cards, and wireless transceivers are examples of different types of network adapter 245 that may be used with system 200.

As pictured in FIG. 2, memory elements 210 store an operating system 250 and one or more application(s) 255. Operating system 250 and application 255, being implemented in the form of executable program code, are executed by system 200 and, as such, are considered an integrated part of system 200. System 200, in executing operating system 250 and application 255, is capable of performing the various operations described with reference to FIG. 1.

Operating system 250, application 255, and any data used, generated, and/or operated upon by system 200 are functional data structures that impart functionality when employed as part of system 200. As defined within this disclosure, a "data structure" is a physical implementation of a data model's organization of data within a physical memory. As such, a data structure is formed of specific electrical or magnetic structural elements in a memory. A data structure imposes physical organization on the data stored in the memory as used by an application program executed using a processor.

System 200 may include fewer components than shown or additional components not illustrated in FIG. 2 depending upon the particular type of device that is implemented. In addition, the particular operating system and/or application(s) included may vary according to device type as may the types of network adapter(s) included. Further, one or more of the illustrative components may be incorporated into, or otherwise form a portion of, another component. For example, a processor may include at least some memory.

Figure 3:
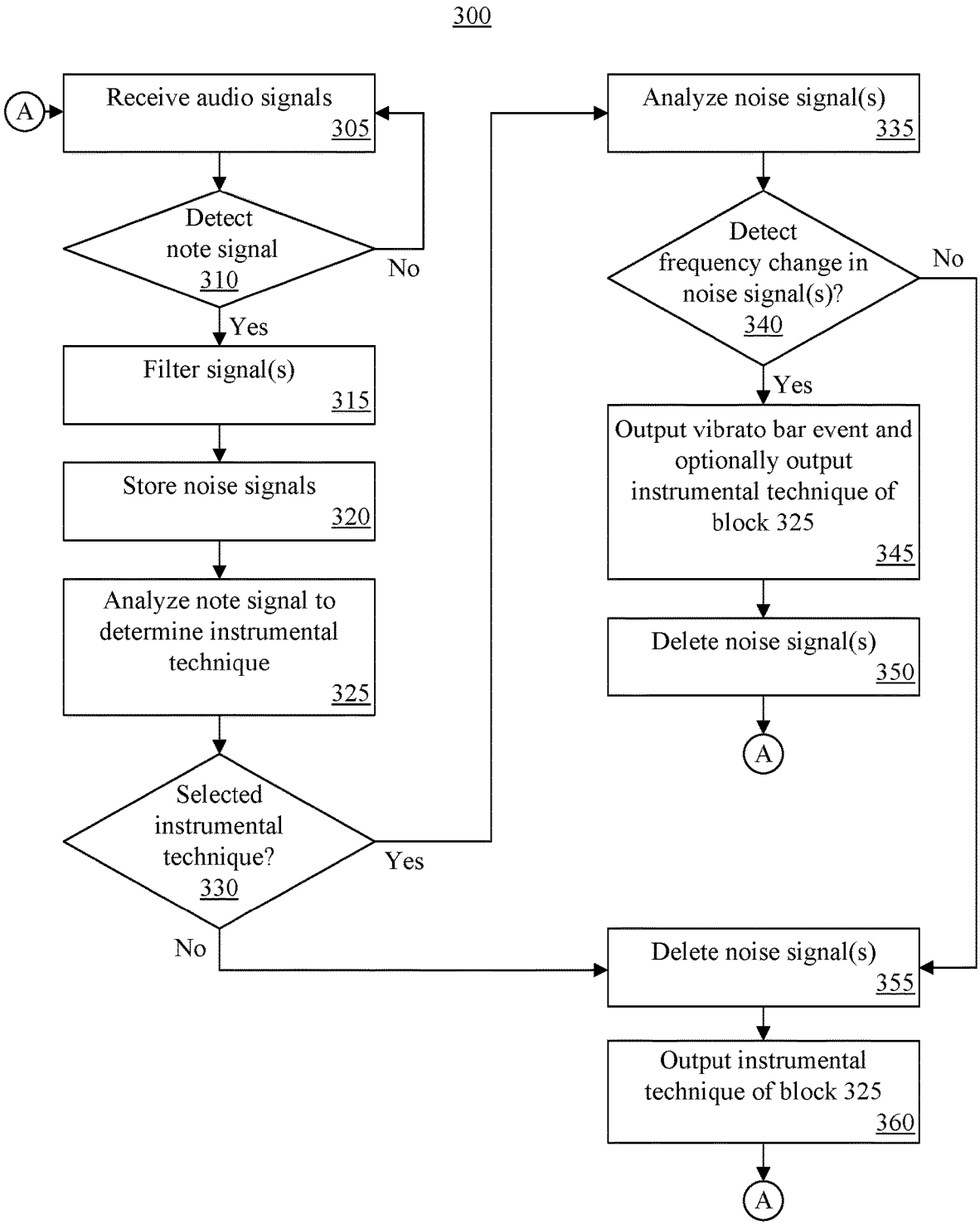
FIG. 3 illustrates an example method of detecting a vibrato bar technique.

FIG. 3 illustrates an example method 300 of detecting a vibrato bar technique. In one or more embodiments, method 300 may be performed by the processor described in connection with FIG. 1. In one or more other embodiments, method 300 may be performed by a system, including a processor, as described in connection with FIG. 2. In any case, it should be appreciated that the signals operated upon may be obtained from an instrument in real time and/or in near real time or read from a data storage device. For purposes of description, method 300 is described as being performed by the "processor" in reference to an architecture as described with reference to either FIG. 1 or FIG. 2. FIG. 3 may be performed automatically by the processor.

In block 305, the processor receives signals. For example, the processor is capable of receiving a plurality of signals generated by a string instrument with a polyphonic pickup. As discussed, each of the multiple signals received corresponds to one string of the string instrument. In one or more embodiments where the processor is implemented as a digital system, the signals may be processed through an analog-to-digital converter in order to generate digital versions of the signals. In one or more embodiments where the processor is implemented as an analog system, the signals may be processed in analog form. As discussed, the signals may also be recorded using a data storage device. In that case the signals may be played or read back from the data storage device and any recording medium used therein for processing.

In block 310, the processor detects a note signal from the received signals. The processor is capable of identifying which of the received signals is sounding a note and which of the received signals is not sounding a note. In this regard, the processor is capable of differentiating between note signals and noise signals. If the processor does not detect a note signal within the received signals, method 300 loops back to block 305 to continue processing. If the processor does detect a note signal within the received signals, method 300 may continue to block 315.

In one or more embodiments, method 300 may only continue past block 310 to block 315 in the case where the processor recognizes a single one of the received signals as a note signal. In one or more other embodiments, method 300 may continue from block 310 to block 315 in the case where the processor recognizes more than one signal as a note signal.

In still another embodiment, method 300 may only continue from block 310 to block 315 only in the case where the processor also detects a smooth change in frequency of the note signal. A smooth change in the frequency of the note signal is an indicator that the vibrato bar of the string instrument may be used. Further, a smooth change in frequency is a characteristic of a bend or a release type of instrumental technique.

In block 315, the processor is capable of filtering the received signals. In an embodiment, the processor is capable of filtering the signals so that note signals are provided to one location while noise signals are provided to another as described herein.

In block 320, the processor stores the noise signals. The processor stores those signals determined to be noise signals for subsequent analysis in certain circumstances. In cases where analysis of the noise signals is not required, or where analysis of the noise signals is completed, the processor may delete the noise signals. As discussed, conventional systems are unable to differentiate between certain instrumental techniques for string instruments as such systems do not store noise signals or perform any analysis upon the noise signals.

In block 325, the processor analyzes the note signal to determine or detect an instrumental technique. In one or more embodiments, the processor is capable of recognizing a plurality of different types of instrumental techniques. These instrumental techniques include, but are not limited to, hammer-ons, pull-offs, bends, releases, and slides. While method 300 is generally described in the context of a note signal, it should be appreciated that the embodiments described within this disclosure are also operative in cases where there is more than one note signal. For example, one or more embodiments described herein are operable in cases where there are two or more note signals and at least one noise signal.

In block 330, the processor determines whether the instrumental technique detected in block 325 is a selected instrumental technique or one of a plurality of selected instrumental techniques. If so, method 300 continues to block 335. If not, method 300 proceeds to block 355. In one or more embodiments, the selected instrumental technique may be any instrumental technique that involves a change in pitch or frequency of the note signal (e.g., hammer-on, pull-off, bend, or release). In one or more other embodiments, the selected technique is a bend or a release. In still another embodiment, the selected instrumental technique may be a detected change in pitch of the note signal.

In block 335, the processor analyzes one or more or all of the noise signals. For example, the processor recalls the noise signal(s) or portions thereof, for the same time interval that is analyzed for the note signal. The processor is capable of analyzing the noise signals to determine whether a change in frequency is detected on the noise signals. In one aspect, the processor may determine a direction of the change in frequency.

In one or more embodiments, the processor analyzes a single noise signal for a change in frequency. For example, the processor may analyze a noise signal that is considered to have a higher likelihood of resulting in an accurate determination of whether the vibrato bar is used. The processor may choose to analyze the noise signal for the string that is adjacent to the string that generated the note signal.

In one or more other embodiments, the processor analyzes two or more or all of the noise signals to detect a change in frequency. For example, the processor may loop through each of the noise signals performing an analysis upon the noise signal to determine whether a change in frequency is detected. Any of the analysis techniques previously described herein for analyzing noise signals may be used.

In block 340, the processor, based upon the analysis of the noise signal(s), determines whether a change in frequency of the noise signal(s) is detected. If so, method 300 continues to block 345. Detecting a change in frequency for one or more or all of the noise signals indicates that the vibrato bar is/was used. If no change in frequency of the noise signal(s) is detected, method 300 continues to block 355. No frequency change of the noise signal(s) indicates that the vibrato bar is/was not used.

In one or more embodiments where a single noise signal is analyzed, method 300 may continue to block 345 in response to the processor determining that the single noise signal exhibits a frequency change. In one or more embodiments were more than one noise signal is analyzed, method 300 may continue to block 345 only in response to the processor determining that two or more or at least a predetermined number of the noise signals exhibit a frequency change.

In one or more embodiments, method 300 may only continue to block 345 in cases where the noise signals that are analyzed exhibit a change in frequency in a same direction as a change in frequency detected in the note signal.

It should be appreciated that for the various embodiments described herein, the noise signal(s) are analyzed for the same time interval as the note signal. In this regard, the note and noise signals are time aligned for purposes of analysis.

In one or more embodiments, the processor may utilize a threshold for purposes of comparing and/or analyzing the noise signal(s). The threshold may be set to compensate for different skill levels in instrumentalists. For example, a novice player may inadvertently allow strings to make noise (be unmuted) while performing various instrumental techniques such as bends or releases. In that case, the threshold may be set higher so that the processor analyzes a minimum number of noise signals, e.g., at least two, at least three, etc. In cases where the number of noise signals is less than the threshold, the processor may exit from block 340 along the "No" path as if a change in frequency is/was not detected. The use of a threshold avoids false positives for use of the vibrato bar when another instrumental technique such as a release or a bend is actually performed by the instrumentalist albeit with reduced skill resulting in more noise than in the case of a more experienced instrumentalist. The threshold may be adjusted based upon skill of the instrumentalist. Thus, a highly skilled instrumentalist, for example, may use a threshold where only a single noise signal need be analyzed or detected in order to detect vibrato bar usage.

In block 345, the processor outputs a vibrato bar event. For example, the processor has determined that the vibrato bar is/was used in generating the note signal. Accordingly, the processor is capable of generating a vibrato bar event. The vibrato bar event indicates that the vibrato bar was used in generating the sound and/or notes detected in the note signal. The vibrato bar event may be provided to one or more other systems thereby causing or triggering any of a variety of different operations to be performed. For example, the vibrato bar event may trigger inclusion of an indication that the vibrato bar was used within a transcription. The indication may be located above the particular notes for which vibrato bar usage is detected.

In one or more embodiments, the processor is capable of determining a direction of movement of the vibrato bar based upon whether the change in frequency of the note signal and/or noise signal(s) increases or decreases. The direction of movement or motion of the vibrato bar may optionally be included in the vibrato bar event. For example, the processor may indicate pulling of the vibrato bar (movement that increases string tension) responsive to increasing frequency of note and/or noise signal(s), while the processor may indicate pushing of the vibrato bar (movement that decreases string tension) responsive to decreasing frequency of note and/or noise signal(s). It should be appreciated that the processor is capable of using either the note signal or one or more of the noise signals for determining the direction or motion of vibrato bar movement. Alternatively, the processor may utilize both note and noise signal(s) for determining direction or motion of vibrato bar movement.

While in some embodiments the processor is capable of determining the movement of the vibrato bar in terms of a push or pull motion, the notes and/or fingering that may be determined and specified within a transcription is also be indicative of the direction of movement of the vibrato bar. The note analysis, which may be performed by a different processor or system, shows notes going down in pitch, notes going up in pitch, or some combination thereof. In this regard, indications of whether the vibrato bar is pushed or pulled within the vibrato bar event may be optional since pairing the vibrato bar event with detected notes from the note signal allows one to infer direction of movement of the vibrato bar.

In one or more embodiments, the processor may also output the instrumental technique or techniques detected in block 325 as events with the vibrato bar event or as part of the vibrato bar event.

In block 350, the processor deletes the noise signal(s). For example, the processor deletes the time interval(s) of the noise signal(s) that are no longer needed. Time intervals of noise signals are no longer needed and may be deleted once a time interval has been evaluated for vibrato bar technique regardless of whether a vibrato bar event is generated.

Continuing from block 330 in the "No" case or from block 340 in the "No" case, method 300 proceeds to block 355. In block 355, the system deletes the noise signals as discussed.

In block 360, the processor outputs the instrumental technique determined in block 325. In block 355, the processor determines that the vibrato bar was not used in the note signal. As such, the original detected instrumental technique from block 325 is considered to be accurate. When method 300 proceeds to block 355 from block 330, the detected instrumental technique is not one of the selected instrumental techniques. When method 300 proceeds to block 355 from block 340, the detected instrumental technique is a selected instrumental technique.

One or more embodiments described within this disclosure are directed to recognizing and/or detecting whether a vibrato bar is used while playing a string instrument. The embodiments described herein address shortcomings in conventional systems that are unable to differentiate between particular instrumental techniques such as bends and releases from vibrato bar usage. Further, in cases where vibrato bar technique is not detected, the instrumental techniques that are detected are validated and considered to be accurate.

Figure 4:
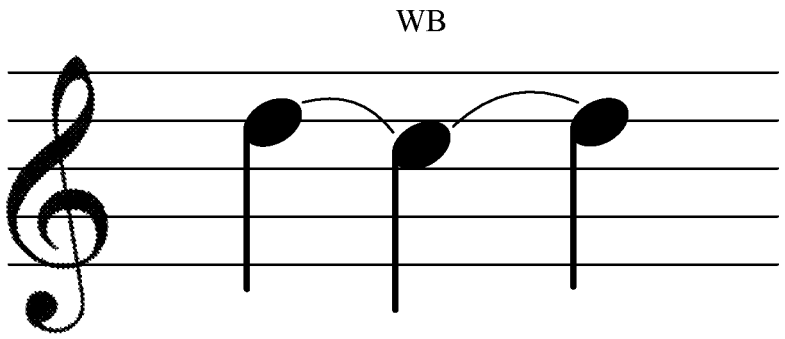
FIG. 4 is an example of a transcription created in accordance with an embodiment of the present invention.

FIG. 4 is an example of a transcription created in accordance with an embodiment of the present invention. In the example of FIG. 4, the system has detected the three notes shown. Because the system also detected usage of the vibrato bar for a note signal specifying the three notes shown, the system also generated and output vibrato bar event(s). A system configured for generating a transcription such as sheet music or the like interprets the vibrato bar event(s) to indicate usage of the vibrato bar in the portion of the transcription above the particular notes for which vibrato bar usage is detected. As pictured, the indication "WB," which stands for "whammy bar," is added to the musical notation to indicate usage of the vibrato bar. It should be appreciated that any of a variety of indicators for vibrato bar usage may be used beyond "WB" within musical notation.

In one or more other embodiments, because the release and bends are detected and may be output, the transcription system has also included the ties connecting each pair of adjacent notes. In this regard, the vibrato bar indicator is added or combined with classical music annotation techniques.

Figure 5:
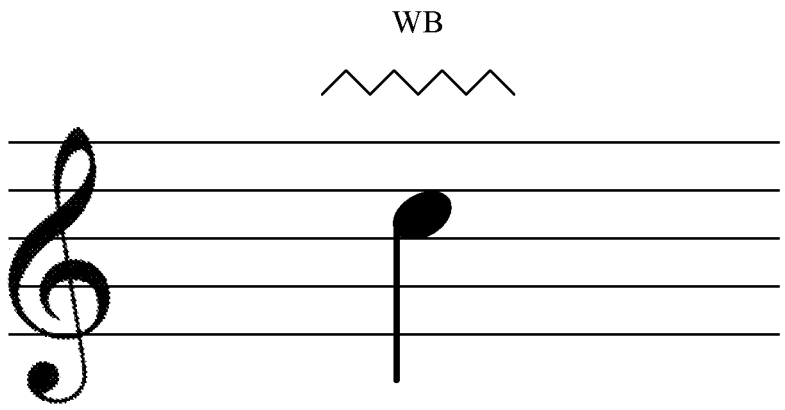
FIG. 5 is another example transcription created in accordance with an embodiment of the present invention.

FIG. 5 is another example transcription created in accordance with an embodiment of the present invention. In the example of FIG. 5, the system has detected the note shown. Because the system also detected usage of the vibrato bar for a note signal specifying the note shown, the system also generated and output vibrato bar event(s). A system configured for generating a transcription such as sheet music or the like interprets the vibrato bar event(s) to indicate usage of the vibrato bar in the portion of the transcription above the particular notes for which vibrato bar usage is detected. As pictured, the indication "WB" is added to the musical notation to indicate usage of the vibrato bar.

In cases where the system does not detect vibrato bar usage, other detected instrumental technique such as vibrato (no vibrato bar), bend, release, etc., are assured to be accurate as opposed to generating a false positive where the vibrato bar was actually used.

In accordance with the inventive arrangements described herein, when a string is played, the processor, or a system including the processor, is capable of storing the signal or waveform of the string that is played (e.g., sounding) and noise signal(s) corresponding to the waveforms of the other strings of the instrument that are not played. In cases where the processor determines that a selected instrumental technique is used based upon an analysis of the played string, the processor performs further analysis on the noise signal(s). The system is capable of determining whether frequency of the noise signal(s) increases, decreases, or remains the same in the time.

If, for example, the processor determines that the frequency of a noise signal does not decrease or does not increase, the processor determines that the vibrato arm is not used. In one or more embodiments, the system may loop through each of the noise signal(s). Accordingly, the system may continue to analyze a next one of the noise signals until each noise signal is analyzed for change in frequency.

If, for example, the processor determines that the frequency of the noise changes, or changes smoothly for a noise signal (e.g., another string), the processor is capable of generating and outputting an event or a signal indicating usage of the vibrato bar. The signal and/or event may also indicate the particular instrumental technique detected with vibrato bar usage. For example, the system may generate a signal or event indicating "bend and vibrato bar usage" or "release and vibrato bar usage".

In one or more embodiments, a "bend with vibrato bar usage" indicates pulling of the vibrato bar or allowing the vibrato bar to return to a rest position from a depressed or pushed position. A "release with vibrato bar" indicates pushing of the vibrato bar or allowing the vibrato bar to return to a rest position from a pulled position.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The terminology used herein is for the purpose of describing particular embodiments only and is not intended to be limiting. Notwithstanding, several definitions that apply throughout this document now will be presented.

As defined herein, the singular forms "a," "an," and "the" are intended to include the plural forms as well, unless the context clearly indicates otherwise.

As defined herein, the term "another" means at least a second or more.

As defined herein, the terms "at least one," "one or more," and "and/or," are open-ended expressions that are both conjunctive and disjunctive in operation unless explicitly stated otherwise. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

As defined herein, the term "automatically" means without user intervention.

As defined herein, the term "coupled" means connected, whether directly without any intervening elements or indirectly with one or more intervening elements, unless otherwise indicated. Two elements may be coupled mechanically, electrically, or communicatively linked through a communication channel, pathway, network, or system.

As defined herein, the terms "includes," "including," "comprises," and/or "comprising," specify the presence of stated features, integers, steps, operations, elements, and/or components, but do not preclude the presence or addition of one or more other features, integers, steps, operations, elements, components, and/or groups thereof.

As defined herein, the term "if" means "when" or "upon" or "in response to" or "responsive to," depending upon the context. Thus, the phrase "if it is determined" or "if [a stated condition or event] is detected" may be construed to mean "upon determining" or "in response to determining" or "upon detecting [the stated condition or event]" or "in response to detecting [the stated condition or event]" or "responsive to detecting [the stated condition or event]" depending on the context.

As defined herein, the terms "one embodiment," "an embodiment," or similar language mean that a particular feature, structure, or characteristic described in connection with the embodiment is included in at least one embodiment described within this disclosure. Thus, appearances of the phrases "in one embodiment," "in an embodiment," and similar language throughout this disclosure may, but do not necessarily, all refer to the same embodiment.

As defined herein, the term "output" means storing in physical memory elements, e.g., devices, writing to display or other peripheral output device, sending or transmitting to another system, exporting, or the like.

As defined herein, the term "plurality" means two or more than two.

As defined herein, the term "real time" means a level of processing responsiveness that a user or system senses as sufficiently immediate for a particular process or determination to be made, or that enables the processor to keep up with some external process.

As defined herein, the term "responsive to" means responding or reacting readily to an action or event. Thus, if a second action is performed "responsive to" a first action, there is a causal relationship between an occurrence of the first action and an occurrence of the second action. The term "responsive to" indicates the causal relationship.

The terms first, second, etc. may be used herein to describe various elements. These elements should not be limited by these terms, as these terms are only used to distinguish one element from another unless stated otherwise or the context clearly indicates otherwise.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A method of detecting vibrato bar technique, comprising:

analyzing, using a processor, a note signal of a string instrument to detect a selected instrumental technique from a plurality of instrumental techniques;

analyzing, using the processor, a noise signal of the string instrument to detect a change in frequency of the noise signal; and generating, using the processor, a vibrato bar event responsive to detecting the selected instrumental technique and the change in frequency of the noise signal.

2. The method of claim 1, wherein the selected instrumental technique involves a change in frequency of the note signal.

3. The method of claim 1, wherein the note signal and the noise signal are analyzed for a same time interval.

4. The method of claim 1, further comprising:

determining a direction of movement of a vibrato bar based upon a direction of change in frequency of at least one of the note signal or the noise signal.

5. The method of claim 1, wherein the selected instrumental technique is a bend or a release.

6. The method of claim 1, further comprising:

storing the noise signal in a memory for analysis.

7. The method of claim 6, wherein the analyzing the noise signal comprises:

recalling the noise signal for a same time interval as the note signal; and analyzing the noise signal for the change in frequency during the same time interval.

8. The method of claim 1, wherein the noise signal includes a plurality of noise signals, wherein each noise signal of the plurality of noise signals is for a different string of the string instrument.

9. The method of claim 1, further comprising:

detecting the note signal and the noise signal from a plurality of received signals.

10. The method of claim 1, wherein the note signal is for a first string of the string instrument sounding a note and the noise signal is for a second string of the string instrument not sounding a note.

11. A method of detecting vibrato bar technique, comprising:

detecting, using a processor, a note signal and a noise signal from a plurality of signals from a string instrument;

analyzing, using the processor, a time interval of the note signal to detect an instrumental technique involving a change in frequency of the note signal occurring within the time interval;

analyzing, in response to detecting the instrumental technique, and using the processor, the noise signal for the time interval to detect a change in frequency of the noise signal; and generating, using the processor, a vibrato bar event in response to a detection of the instrumental technique and the change in frequency of the noise signal.

12. A system for detecting vibrato bar technique, comprising:

a processor configured to:

analyze a note signal of a string instrument to detect a selected instrumental technique from a plurality of instrumental techniques;

analyze a noise signal of the string instrument to detect a change in frequency of the noise signal; and generate a vibrato bar event responsive to detecting the selected instrumental technique and the change in frequency of the noise signal.

13. The system of claim 12, wherein the selected instrumental technique involves a change in frequency of the note signal.

14. The system of claim 12, wherein the note signal and the noise signal are analyzed for a same time interval.

15. The system of claim 12, wherein the processor is further configured to:

determine a direction of movement of a vibrato bar based upon a direction of change in frequency of at least one of the note signal or the noise signal.

16. The system of claim 12, wherein the selected instrumental technique is a bend or a release.

17. The system of claim 12, wherein the processor is further configured to:

store the noise signal in a memory for analysis.

18. The system of claim 17, wherein the processor is configured to recall the noise signal for a same time interval as the note signal and analyze the noise signal for the change in frequency during the same time interval.

19. The system of claim 12, wherein the noise signal includes a plurality of noise signals, wherein each noise signal of the plurality of noise signals is for a different string of the string instrument.

20. The system of claim 12, wherein the processor is further configured to:

detect the note signal and the noise signal from a plurality of received signals.

21. The system of claim 12, wherein the note signal is for a first string of the string instrument sounding a note and the noise signal is for a second string of the string instrument not sounding a note.

22. A system for detecting vibrato bar technique, comprising:

a processor configured to:

determine a note signal and a noise signal from a plurality of signals from a string instrument;

analyze a time interval of the note signal to detect an instrumental technique involving a change in frequency of the note signal occurring within the time interval;

analyze, in response to detecting the instrumental technique, the noise signal for the time interval to detect a change in frequency of the noise signal; and generate a vibrato bar event in response to a detection of the instrumental technique and the change in frequency of the noise signal.

23. A computer program product for detecting vibrato bar technique, the computer program product comprising a computer readable storage medium having program instructions embodied therewith, the program instructions executable by a processor to cause the processor to:

analyze, using the processor, a note signal of a string instrument to detect a selected instrumental technique from a plurality of instrumental techniques;

analyze, using the processor, a noise signal of the string instrument to detect a change in frequency of the noise signal; and generate, using the processor, a vibrato bar event responsive to detecting the selected instrumental technique and the change in frequency of the noise signal.

24. The computer program product of claim 23, wherein the selected instrumental technique involves a change in frequency of the note signal.

25. The computer program product of claim 23, wherein the note signal and the noise signal are analyzed for a same time interval.

* * * * *